United States Patent [19]

Brown

[11] 4,114,228

[45] * Sep. 19, 1978

[54] CREPING DOCTOR DEVICE

[75] Inventor: Jack Frederick Brown, Pierrefonds, Canada

[73] Assignee: James Ross Limited, Lachine, Canada

[ * ] Notice: The portion of the term of this patent subsequent to Jan. 14, 1992, has been disclaimed.

[21] Appl. No.: 693,831

[22] Filed: Jun. 8, 1976

Related U.S. Application Data

[63] Continuation-in-part of Ser. No. 614,831, Sep. 18, 1975, abandoned.

[51] Int. Cl.[2] ..... D21G 3/00

[52] U.S. Cl. ..... 15/256.51; 101/425; 118/126; 355/15

[58] Field of Search ..... 15/256.51; 101/425; 118/126; 355/15

[56] References Cited

U.S. PATENT DOCUMENTS

| | | | |
|---|---|---|---|
| 3,559,229 | 2/1971 | DeNoyer | 15/256.51 |
| 3,688,336 | 9/1972 | Costello, Jr. et al. | 15/256.51 |
| 3,711,888 | 1/1973 | Dunlap | 15/256.51 |
| 3,859,690 | 1/1975 | Brown | 15/256.51 |

*Primary Examiner*—Edward L. Roberts
*Attorney, Agent, or Firm*—Charles E. Brown

[57] ABSTRACT

This invention relates to a doctor blade assembly which is an improvement of the assembly as taught in U.S. Pat. No. 3,859,690, as well as to an improved pressure finger which can be used in the assembly. The improved finger includes a bearing part on which the finger can be pivotably mounted. Extending forwardly of the bearing part are two spaced apart jaws having inner facing surfaces which define, between them, mounting slots for the doctor blade. The inner surfaces comprise a plurality of parallel, spaced, transverse grooves, with respective ones of the grooves in one surface being aligned with respective ones of the grooves in the other surfaces. The aligned grooves form vertical sets of grooves, and all fingers on the assembly are disposed so that respective sets of one finger are aligned with respective sets in all other fingers to define a plurality of transverse channels or passages. A blade stop means is inserted through the channels to provide a definite position for the rear end of the blade, and the stop means can be advanced, in the forward channels, or moved back to the rearward channels, depending on the width of the blade, to insure substantially equal blade frontage.

15 Claims, 9 Drawing Figures

Fig. 4A
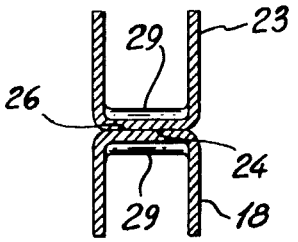
Fig. 5A
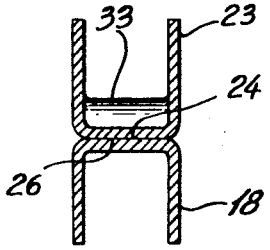
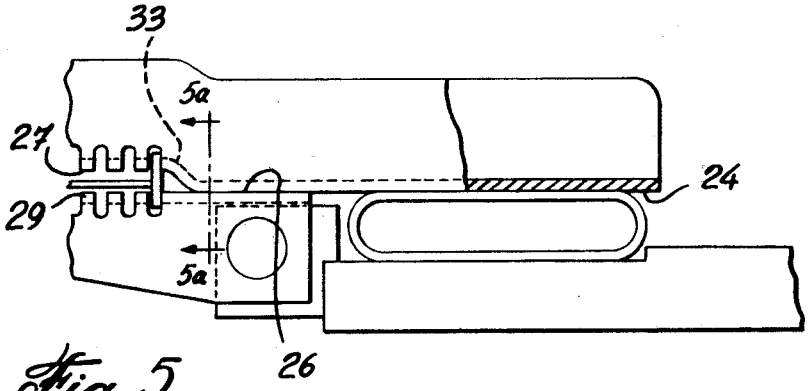
Fig. 5
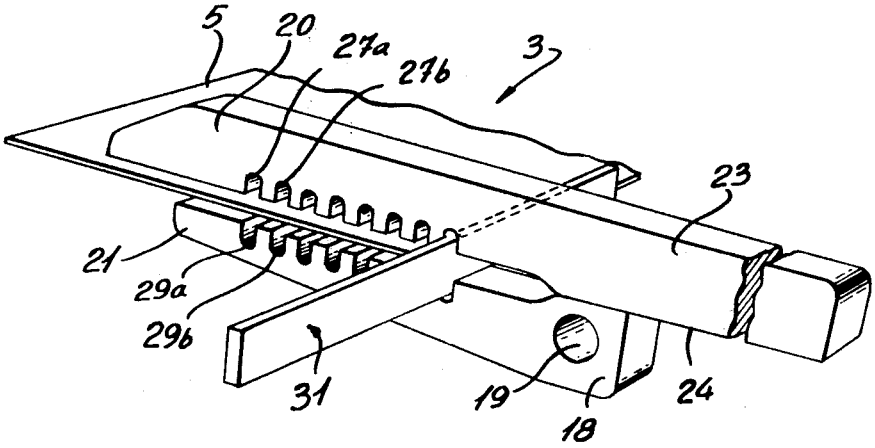
Fig. 6

CREPING DOCTOR DEVICE

CROSS-REFERENCE TO RELATED APPLICATIONS

This application is a continuation-in-part of U.S. application Ser. No. 614,831, filed Sept. 18, 1975 and now abandoned.

BACKGROUND OF THE INVENTION

1. Field of the Invention

This invention relates to doctor blade assemblies. More specifically, this invention relates to improvements in the pressure finger of the type of doctor blade assembly as described and claimed in U.S. Pat. No. 3,859,690, Brown, Jan. 14, 1975, as well as to improvements in the assembly per se.

2. Description of the Prior Art

The assembly of the above noted patent requires a separate blade seat structure which includes a stop member to prevent the blade from moving backwards into the slot of the assembly. The blade seat, in practical application, has caused several difficulties. Thus, as mentioned in the patent, a set of blade seats must be provided with each doctor assembly so that the blade can be held at a more forward position as its front edge is ground down. The seats are relatively expensive so that the requirement for such seats substantially increases the cost of the assembly.

In addition, the resin like coating on the surface of the roll on which the doctor assembly is acting falls into the spaces between the fingers and adheres to the surface of the seat. Because of this, the seat will stick in the assembly and will present some difficulties when an operator attempts to remove the seat. Although it was mentioned in the patent that, when the seat is removed, this dirt will be scraped off by the edges of the fingers, nevertheless, since there is such a large surface involved, as mentioned above, there may be difficulties when attempting to remove the seat.

SUMMARY OF THE INVENTION

It is therefore an object of the present invention to provide a doctor assembly which overcomes the above disadvantages.

It is a further object of the invention to provide a doctor assembly which does not require a blade seat of the type referred to in the above mentioned patent.

It is a still further object of the invention to provide a doctor assembly wherein the function of the blade seat of the above mentioned patent is performed by other means which are less expensive and simpler in construction.

The above objects, and other objects which will become apparent from a reading of the disclosure, are achieved in accordance with the invention by providing a pressure finger for a doctor assembly comprising; a bearing part permitting the finger to be pivotably mounted; first and second jaws extending forwardly of the bearing part, each jaw comprising an inner surface, the inner surface of said first jaw being spaced from but facing the inner surface of said second jaw, the surfaces defining therebetween a mounting slot for receiving the doctor blade; characterized in that each said inner surfaces comprises a plurality of transverse parallel, spaced, grooves; respective ones of said grooves in one of said surfaces being aligned with respective ones of said grooves in the other one of said surfaces.

The finger may further comprise a tongue extending rearwardly of said bearing part and in a direction opposite to the direction of said jaws, said tongue comprising a bearing surface contacting a pressure means acting to urge the finger, about the bearing part, in a doctoring direction.

The first jaw and the tongue may be co-extensive and integrally formed to provide a first member, the inner surface of the first jaw being co-extensive with the bearing surface of the inner surface of said first jaw.

The jaws and tongue may by U-shaped in cross-section. The pressure finger may be formed of sheet metal and stamped into shape.

The invention also relates to a doctor blade assembly comprising an array of parallel, spaced apart, pressure fingers connected to each other by a pressure plate; each of the fingers comprising a bearing part for individual pivotal mounting of the fingers on the assembly; and first and second jaws extending forwardly of the bearing part, each jaw comprising an inner surface, the inner surface of said first jaw being spaced from but facing the inner surface of said second jaw, the surfaces defining therebetween a mounting slot for receiving the doctor blade; characterized in that each said inner surfaces comprises a plurality of transverse parallel, spaced, grooves; respective ones of said grooves in one of said surfaces being aligned with respective ones of said grooves in the other one of said surfaces to form respective sets of grooves, respective sets of grooves of said pressure fingers being aligned to form a plurality of transverse channels in said assembly; the pressure plate being secured to the inner surfaces of each of said first jaws forwardly of the transverse parallel grooves.

The assembly preferably comprises blade stop means; said blade stop means being adapted to be inserted through any one of said channels to traverse the assembly.

The blade stop means may comprise a rectangular plate having a rectangular cross section.

Alternatively, the blade stop means may comprise a rectangular plate having a cross section comprising one flat side and a protrusion on the side opposite said flat side. Said protrusion is preferably rectangular in cross section and is centered on said opposite side.

In a still further embodiment, the assembly may comprise two different blade stop means, one of said blade stop means comprising a rectangular plate having a rectangular cross section, the other of said blade stop means comprising a rectangular plate having a substantially U-shaped cross section.

In a preferred embodiment, a doctor blade pressure plate assembly to hold a doctor blade against a cylinder to be doctored, comprises; a pressure plate extending the width of the cylinder and having a straight terminal edge adjacent the cylinder; an array of parallel spaced apart pressure fingers connected to the pressure plate rearwardly of the terminal edge; each pressure finger comprising a bearing part for pivotably mounting the fingers on the assembly, and a pair of jaws extending forwardly of the bearing part, said jaws comprising inner spaced apart facing surfaces defining therebetween a doctor blade receiving slot; each of said inner surfaces comprising a plurality of transverse parallel spaced grooves, respective ones of said grooves in one of said surfaces being aligned with respective ones of said grooves in the other one of said surfaces to form respective sets of grooves, respective sets of grooves in all fingers being aligned to form a plurality of channels;

the pressure plate being connected to the inner surface of the same one of said jaws of each finger and forwardly of said grooves, and extending beyond the forward edge of each of said same one of said jaws to its terminal edge; a tongue on each finger extending rearwardly of said bearing part and co-extensively with said one of said jaws; said tongue comprising a bearing surface for contact with a resilient pressure means; and blade stop means adapted to be inserted through any one of said channels to traverse the assembly.

BRIEF DESCRIPTION OF THE DRAWINGS

The invention will be better understood by an examination of the following description together with the accompanying drawings in which:

FIG. 4*a* is an end view of FIG. 4;

FIG. 5 is a view similar to FIG. 3 showing a third embodiment of the invention;

FIG. 5*a* is an end view of FIG. 5;

FIG. 6 is a perspective view of a finger and blade stop means in accordance with the invention.

DETAILED DESCRIPTION OF THE DRAWINGS

Figure 1:
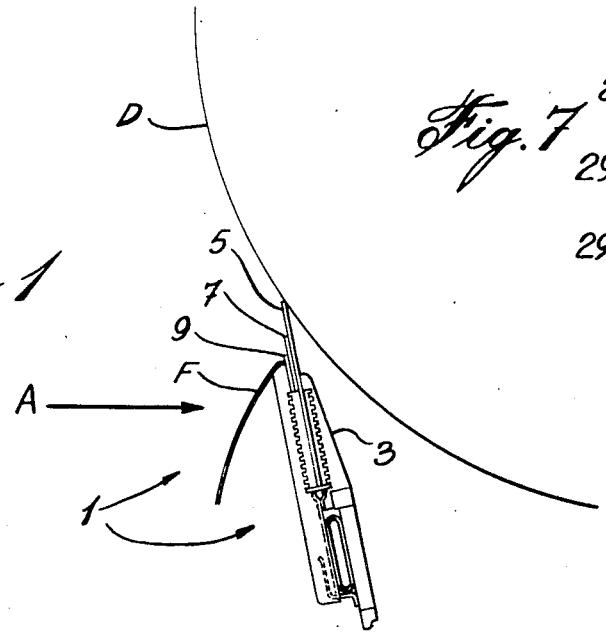
FIG. 1 is a fragmentary side elevation showing a typical relationship between a doctor and a roll to be doctored.

FIG. 1 illustrates the general environment in which a doctor blade assembly, including the pressure fingers of the invention, is used. FIG. 1 illustrates a creping doctor arrangement, but the assembly and pressure fingers of the instant invention can be used in any doctoring application.

Figure 2:
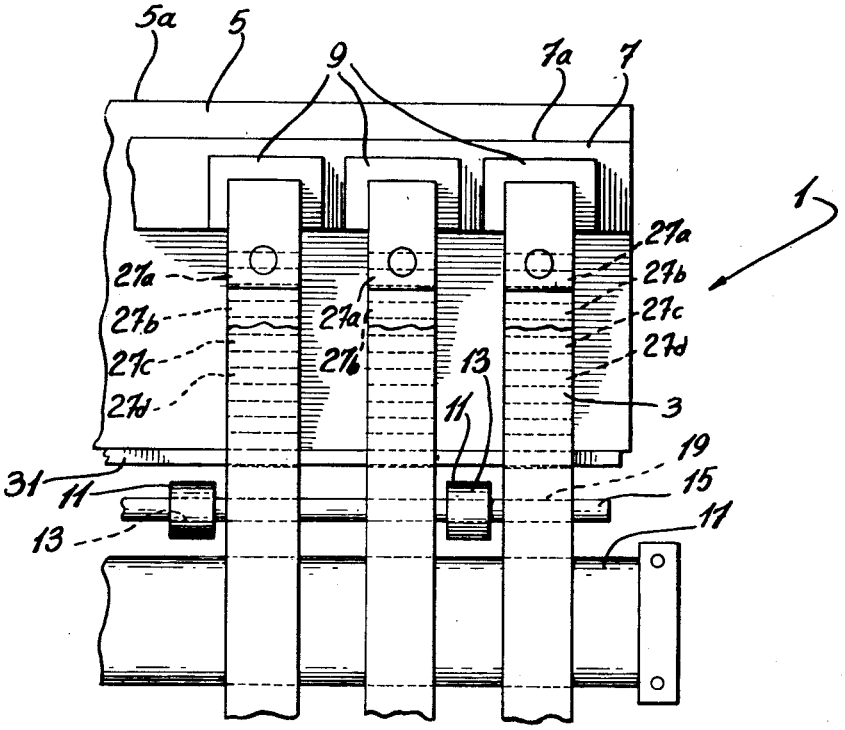
FIG. 2 is a fragmentary view in the direction of A in FIG. 1 of a doctor assembly in accordance with the invention.

In FIG. 1, the assembly, illustrated generally at 1, includes a plurality of spaced apart pressure fingers 3 (see also FIG. 2). The pressure fingers support a doctor blade 5 and a pressure plate 7 and each finger holds a pressure pad 9. The assembly is disposed adjacent a cylinder D, such as a drying cylinder or a cylinder to be doctored, and a flexible apron F is provided to prevent access of waste material to the moving parts of the assembly.

Referring now to FIG. 2, as can be seen, the fingers 3 are mounted in spaced apart, parallel relationship along the blade 5 and rearward of the front terminating edge 5*a* thereof. The fingers are connected to pressure plate 7, and each finger has a pressure pad 9 disposed between itself and the pressure plate.

Mounted on a support surface 10 of a mounting member (see FIG. 3) are a plurality of support blocks 11 each having aligned apertures 13 therethrough. The apertures are aligned to receive a pivot rod 15, and the fingers are pivotably mounted on the pivot rod on their bearing parts as will be described below. A bearing surface of each pressure finger contacts the inflatable tube 17 which acts as a pressure means to pivot the fingers about their bearing means as will be seen below.

Figure 3:
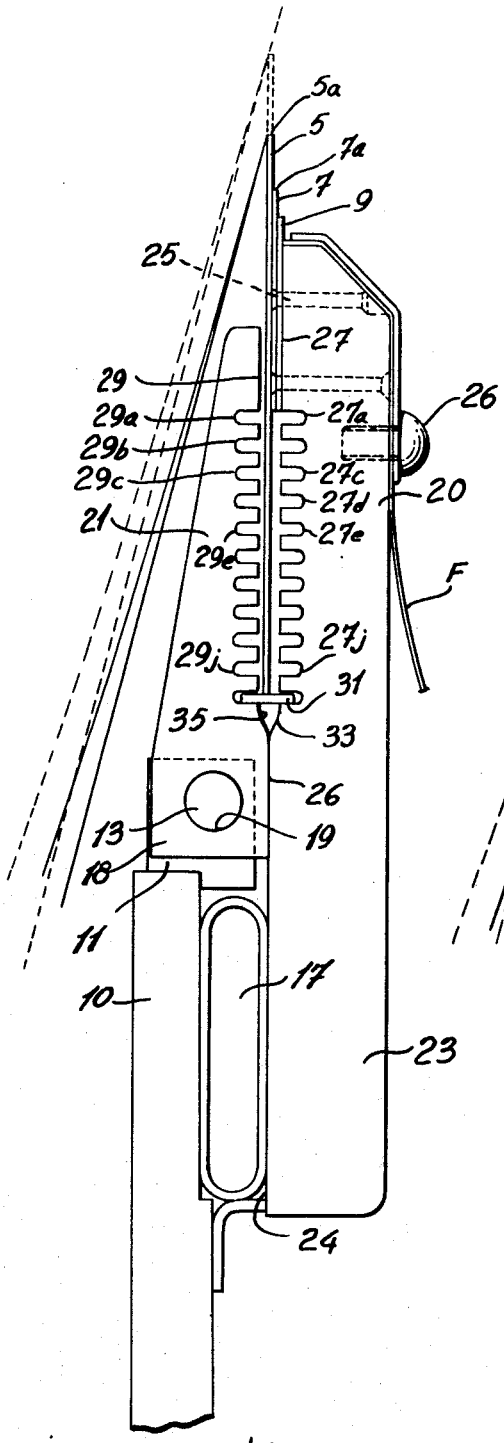
FIG. 3 is a side view showing in greater detail one embodiment of a finger in accordance with the invention.

Referring now to FIG. 3, one embodiment of a pressure finger in accordance with the invention comprises a bearing part 18 having an aperture 19 therethrough. The apertures of all fingers in the assembly are aligned with each other and with the apertures 13 in the blocks 11 so that rod 15 passes through all of the apertures. The diameters of the apertures 19 are greater than the diameter of the rod 15 so that the fingers are pivotable about the rod 15 in both the longitudinal and transverse planes as described in the above patent.

The finger further includes jaws 20 and 21 which extend forwardly of the bearing part 18. Disposed in the inner facing, spaced apart surfaces 27 and 29 are a series of parallel, spaced, transverse grooves 27*a*, 27*b*, 27*c* . . . and 29*a*, 29*b*, 29*c* . . . respectively. The grooves are also illustrated in FIG. 6, and, as can be seen, the grooves 27*a* are aligned with the grooves 29*a*, the grooves 27*b* are aligned with the grooves 29*b*, and so forth. Each of the aligned grooves constitutes a set of vertically aligned grooves, and the vertically aligned grooves of all the fingers are aligned with respective ones of the vertically aligned grooves in all other fingers in the horizontal direction as can be seen in FIG. 2. With the horizontal alignment, the sets of grooves present a transverse passage or channel across the assembly.

Each transverse passage or channel can receive a blade stop means 31 shown in FIG. 3 in the most rearward channel. As can be seen in FIG. 2, the blade stop means traverses the assembly. The blade stop means can comprise a rectangular plate as seen in FIG. 6. As will be clear, the shape of the blade stop means can be altered to suit the shape of the accommodating channels.

The surfaces 27 and 29 are spaced apart to define a mounting slot for receiving the doctor blade 5, the pressure plate 7 and the pressure pad 9.

The finger further comprises a tongue 23 which extends rearwardly of the bearing part, and is co-extensive with the jaw 20. The tongue and jaw 20 can be made as a single integral member, and the other jaw 21 can be made integrally with the bearing part to form another member. The two members can then be joined together as by welding, riveting screwing etc. to form the finger.

The tongue includes a bearing surface 24, which is co-extensive with the surface 27 of the jaw 20, and the bearing surface 24 is in contact with the inflatable tube 17. The inflatable tube is, in turn, mounted on the support surface 10.

Means 25 are included for attaching the fingers to the pressure plate and pressure pad, and means 26, such as screw and bolt means, attach the flexible apron F to the fingers.

In operation, the assembly works as follows:

When the blade is new and of full width, the stop means 31 can be inserted in the most rearward passage or channel. The stop means provides a definite and fixed rearward position for the blade. As the blade is worn down and reground, the stop means will be moved out of the most rearward channel and moved into more forward channels such that the frontage of the blade, i.e., the distance between the front edge 7*a* of the pressure plate 7, and the front edge 5*a* of the blade 5, remains substantially equal regardless of the width of the blade. With this type of arrangement, the surface of the stop means on which dirt of the process can be deposited is small relative to the similar surface of the blade seat of the above mentioned patent, so that the removal of the plate will not be hampered to as great an extent by the dirt. In addition, only one plate, which is relatively inexpensive, has to be supplied with each assembly versus a set of expensive blade seats of the patented arrangement.

In addition, the fingers can accommodate blades of different initial widths. Thus, the finger would be made to be useful with the widest width blades available. If a shorter width blade is purchased, it is merely necessary to insert the plate in the channel appropriate to this width. No extra parts or different parts are necessary.

Figure 4:
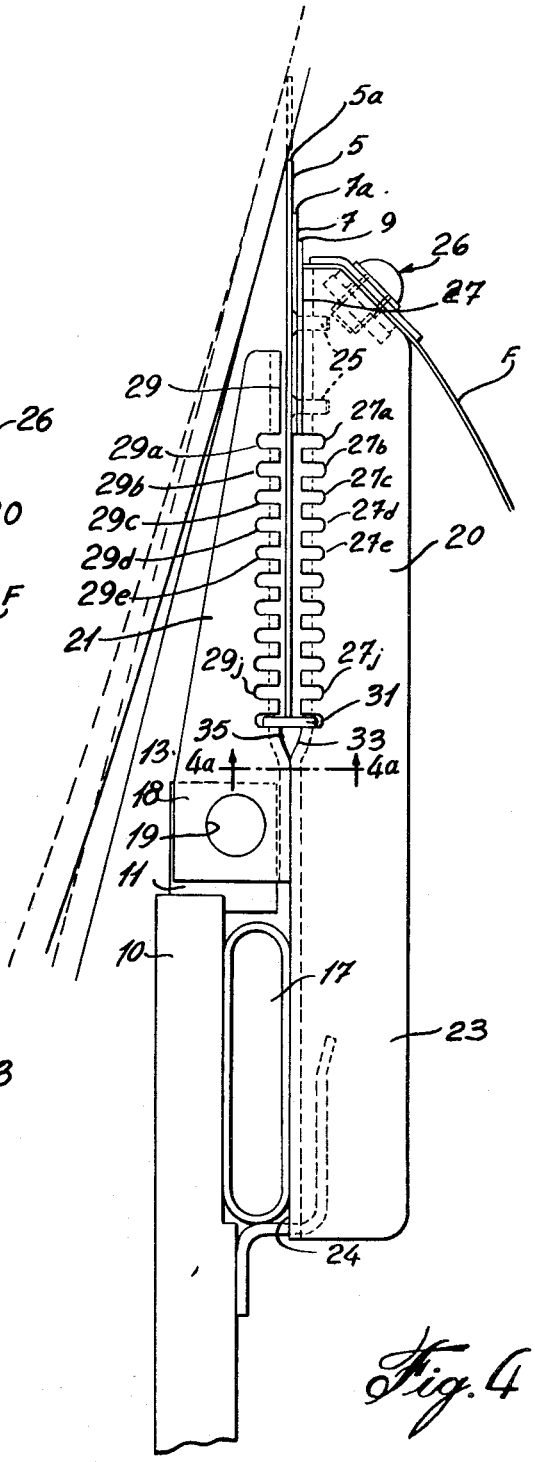
FIG. 4 is a view similar to FIG. 3 showing a second embodiment of the invention.

In FIG. 3, the finger is shown made of a solid material. However, in a preferred embodiment, the fingers are made of sheet metal and stamped into shape. Such an arrangement is shown in FIGS. 4 and 4*a*. As can be seen in FIG. 4*a*, the top and bottom members are substantially U-shaped in cross section. The bases of the U's comprise the inner surfaces 27, 29, 24 and 26, and the grooves are cut-outs in these surfaces.

In the FIG. 4 embodiment, surface 24 is joined to surface 27 by sloping part 33, and surface 26 is joined to surface 29 by sloping part 35. The sloping parts provide for the spacing between surfaces 27 and 29 while permitting surfaces 24 and 26 to abut each other.

In a further embodiment, as shown in FIG. 5, surfaces 26 and 29 are at the same level and in a straight line, and only sloping part 33 provides the spacing between surfaces 27 and 29. As can be seen in FIG. 5*a*, the cross sectional shape of the members of this finger are also substantially U-shaped.

It will of course be appreciated that, with the arrangement as above described, the blade position can be advanced only by a series of discrete steps. Thus, referring to FIG. 7, and remembering that all of the grooves are equally spaced and of equal size, then the blade can be advanced or backed up only by a discrete distance equal to A or an integral multiple thereof. In practice, because of the nature of the materials used, the distance A cannot be reduced to less than one-fourth inch. However, it has been found that it would be preferable to have a finer than one-fourth inch adjustability capability.

Figure 7:
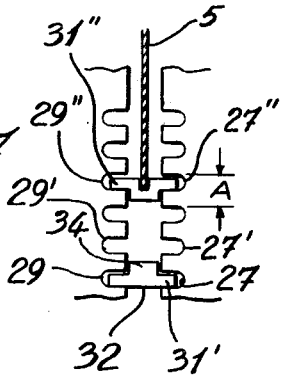
FIG. 7 illustrates two different forms for the blade stop means.

To provide such finer adjustability, applicant provides stop means 31' and/or 31'' illustrated in FIG. 7.

As can be seen, stop means 31' will also be a rectangular plate. However, this plate has a cross section with one flat side 32. A protrusion 34 is provided on the side opposite the flat side. The protrusion 34 is centered on the opposite side and is itself rectangular in cross section. As will be appreciated, the protrusion will extend across the entire length of the rectangular plate. The protrusion will extend approximately half the distance between grooves.

In operation, the stop means can be inserted so that the flat side 32 is facing the front and the blade abuts against the flat end. (i.e., opposite from what is shown in FIG. 7). When the blade is somewhat worn down, and it is required to advance the blade by one-eighth inch, the stop means 31 is pulled out of the groove and turned around and reinserted into the grooves so that it appears as shown in FIG. 7. Thus, the blade will now abut against the side of the protrusion 34, so that it will be advanced by half the distance between the grooves, i.e., one-eighth inch.

The stop means 31'' is used in conjunction with stop means as illustrated in FIGS. 3 and 4, i.e., a stop means which is rectangular in cross section. This stop means is substantially U-shaped in cross section, and the inner surface of the U extends substantially half way between grooves, i.e., approximately one-eighth inch.

In operation, the assembly with the two stop means would work as follows: originally, a rectangular cross section stop means would be inserted in the grooves 27', 29'. After the edge of the blade has worn down somewhat, and it is desired to advance it by one-eighth inch, the stop means 31'' is inserted in the grooves 27'', 29''. As the inner surface of the U of this stop means is one-eighth inch in advance of the front end of the grooves 27', 29', the blade will be advanced by one-eighth inch.

When the blade is worn down some more, and it is desired to advance the blade by a further one-eighth inch, the stop means 31' is taken out of the grooves 27', 29', and a rectangular shaped stop means is inserted in the same grooves. Thus, the blade will be advanced by a further one-eighth inch.

I claim:

1. A pressure finger for a doctor blade pressure blade assembly, comprising:

a bearing part permitting the finger to be pivotably mounted;

first and second jaws extending forwardly of the bearing part, each jaw comprising an inner surface, the inner surface of said first jaw being spaced from but facing the inner surface of said second jaw, the surfaces defining therebetween a mounting slot for receiving the doctor blade;

wherein said inner surfaces have mounting means for adjustably mounting a doctor blade stop extending across said mounting slot, said mounting means including each said inner surfaces having a plurality of transverse parallel grooves spacing longitudinally of said mounting slot;

respective ones of said grooves in one of said surfaces being aligned transversely of said mounting slot with respective ones of said grooves in the other one of said surfaces;

and further comprising a tongue extending rearwardly of said bearing part and in a direction opposite to the direction of said jaws, said tongue comprising a bearing surface contacting a pressure means acting to urge the finger, about the bearing part, in a doctoring direction.

2. A pressure finger as defined in claim 1 wherein said first jaw and said tongue are co-extensive and integrally formed to provide a first member, the inner surface of said first jaw being co-extensive with the bearing surface of said inner surface of said first jaw.

3. A pressure finger as defined in claim 1 wherein said jaws and said tongue are U-shaped in cross section.

4. A pressure finger as defined in claim 3 wherein said pressure finger is formed of sheet metal and stamped into shape.

5. A pressure finger as defined in claim 1 wherein said second jaw is formed integrally with said bearing part to form a second member, said first and second members being joined together to form said pressure finger.

6. A doctor blade assembly comprising an array of parallel, spaced apart, pressure fingers connected to each other by a pressure plate;

each of the fingers comprising a bearing part for individual pivotal mounting of the fingers on the assembly;

and first and second jaws extending forwardly of the bearing part, each jaw comprising an inner surface, the inner surface of said first jaw being spaced from but facing the inner surface of said second jaw, the surfaces defining therebetween a mounting slot for receiving the doctor blade;

characterized in that each said inner surfaces comprises a plurality of transverse parallel, spaced, grooves;

respective ones of said grooves in one of said surfaces being aligned with respective ones of said grooves in the other one of said surfaces to form respective sets of grooves, respective sets of grooves of said pressure fingers being aligned to form a plurality of transverse channels in said assembly;

the pressure plate being secured to the inner surfaces of each of said first jaws forwardly of the transverse parallel grooves.

7. An assembly as defined in claim 6 and further comprising blade stop means;

said blade stop means being adapted to be inserted through any one of said channels to traverse the assembly.

8. An assembly as defined in claim 7 wherein said blade stop means comprises a rectangular plate having a rectangular cross section.

9. An assembly as defined in claim 7 wherein said blade stop means comprises a rectangular plate having a cross section comprising one flat side and a protrusion on the side opposite said flat side.

10. An assembly as defined in claim 9 wherein said protrusion is rectangular in cross section and is centered on said opposite side.

11. An assembly as defined in claim 7 wherein said blade stop means comprises a rectangular plate having a substantially U-shaped cross section.

12. A doctor blade pressure plate assembly to hold a doctor blade against a cylinder to be doctored, comprising:

a pressure plate extending the width of the cylinder and having a straight terminal edge adjacent the cylinder;

an array of parallel spaced apart pressure fingers connected to the pressure plate rearwardly of the terminal edge;

each pressure finger comprising a bearing part for pivotably mounting the fingers on the assembly, and a pair of jaws extending forwardly of the bearing part, said jaws comprising inner spaced apart facing surfaces defining therebetween a doctor blade receiving slot;

each of said inner surfaces comprising a plurality of transverse parallel spaced grooves, respective ones of said grooves in one of said surfaces being aligned with respective ones of said grooves in the other one of said surfaces to form respective sets of grooves, respective sets of grooves in all fingers being aligned to form a plurality of channels;

the pressure plate being connected to the inner surface of the same one of said jaws of each finger and forwardly of said grooves, and extending beyond the forward edge of each of said same one of said jaws to its terminal edge;

a tongue on each finger extending rearwardly of said bearing part and co-extensively with said one of said jaws;

said tongue comprising a bearing surface for contact with a resilient pressure means;

and blade stop means adapted to be inserted through any one of said channels to traverse the assembly.

13. An assembly as defined in claim 12 and further comprising a pressure pad disposed between the same one of said jaws of each pressure finger and the pressure plate.

14. An assembly as defined in claim 12 wherein said bearing part of each pressure finger comprises an aperture in said pressure finger, and wherein each said finger is pivotably mounted on said assembly by a pivot rod passing through the apertures of each pressure finger.

15. A doctor blade assembly comprising an array of parallel, spaced apart, pressure fingers connected to each other by a pressure plate;

each of the fingers comprising a bearing part for individual pivotal mounting of the fingers on the assembly;

and first and second jaws extending forwardly of the bearing part, each jaw comprising an inner surface, the inner surface of the first jaw being spaced from but facing the inner surface of the second jaw, the surfaces defining therebetween a mounting slot for receiving the doctor blade;

characterized in that means are provided in both said surfaces for mounting a doctor blade stop in a position extending transversely of said mounting slot and selectively longitudinally of said mounting slot, said means in both said surfaces cooperating to form a plurality of transverse channels traversing said mounting slot.

* * * * *